US005945243A

United States Patent [19]

Nakamura et al.

[11] Patent Number: 5,945,243

[45] Date of Patent: Aug. 31, 1999

[54] PHOTOCONDUCTOR FOR ELECTROPHOTOGRAPHY AND METHOD OF MANUFACTURING THE SAME

[75] Inventors: Yoichi Nakamura; Kazumi Egota; Seizo Kitagawa; Naoki Itoh, all of Nagano, Japan

[73] Assignee: Fuji Electric Co., Ltd, Japan

[21] Appl. No.: 09/099,987

[22] Filed: Jun. 19, 1998

[30] Foreign Application Priority Data

Jun. 19, 1997 [JP] Japan ..... 9-162448

[51] Int. Cl.[6] ..... G03G 5/04; G03G 15/00

[52] U.S. Cl. ..... 430/83; 430/56; 430/58; 430/59; 430/132; 430/134; 399/159

[58] Field of Search ..... 430/56, 58, 59, 430/83, 132, 134

[56] References Cited

U.S. PATENT DOCUMENTS

| | | | |
|---|---|---|---|
| 3,978,020 | 8/1976 | Liberti | 524/109 |
| 5,193,633 | 3/1993 | Iwasaki et al. | 430/59 |
| 5,238,767 | 8/1993 | Horiie | 430/110 |
| 5,342,862 | 8/1994 | Reich | 523/125 |
| 5,474,868 | 12/1995 | Adachi et al. | 430/56 |
| 5,567,557 | 10/1996 | Mori | 430/132 |
| 5,618,846 | 4/1997 | Nogami et al. | 430/58 |
| 5,804,345 | 9/1998 | Itami et al. | 430/83 |
| 5,815,776 | 9/1998 | Nukada | 399/174 |

*Primary Examiner*—Roland Martin
*Attorney, Agent, or Firm*—Morrison Law Firm

[57] ABSTRACT

An electrophotographic photoconductor includes a conductive substrate having a photoconductive film thereon. The photoconductive film includes a layer containing a charge transport agent and a phosphonite compound, which acts as an antioxidant. Preferably, the phosphonite compound is diarylarylphosphonite. The layer that contains the charge transport preferably contains from 0.005 to 10 weight % of diarylarylphosphonite. The diarylarylphosphonite is preferably a compound selected from the group consisting of bis(2,4-di-tert-butylphenyl)phenylphosphonite, bis(2,6-di-tert-butylphenyl)phenylphosphonite and bis(2,6-di-tert-butyl-4-methylphenyl)phenylphosphonite.

15 Claims, 2 Drawing Sheets

PHOTOCONDUCTOR FOR ELECTROPHOTOGRAPHY AND METHOD OF MANUFACTURING THE SAME

BACKGROUND OF THE INVENTION

The present invention relates to a photoconductor for electrophotography (hereinafter referred to as a "photoconductor") for use in electrophotographic apparatuses, such as printers, copying machines, and facsimiles. In particular, the present invention relates to a photoconductor which includes a photoconductive film having a stable layer containing a charge transport agent. The present invention also relates to an electrophotographic apparatus which includes the photoconductor of the present invention, as well as a method of manufacturing such a photoconductor.

Photoconductors retain surface charges in the dark, generate electric charges in response to received light, and transport the generated electric charges in response to the received light. Photoconductors may be classified into monolayered photoconductors, which have a single layer that exhibits all the above described functions, and laminate-type photoconductors, which have one layer for charge generation and a second, separate layer for charge retention in the dark and charge transport in received light.

Conventional photoconductors employ the Carlson method for electrophotographic image formation. Image formation by the Carlson method requires charging the photoconductor in the dark by corona-discharge, forming electrostatic images of the original letters and pictures on the charged surface of the photoconductor, developing the electrostatic images with toner, and copying the developed toner images to the carrier paper. The photoconductor is ready for reuse after discharging, removal of residual toner and optical discharging are completed.

Photoconductive materials used in photoconductors include inorganic materials such as selenium, selenium alloys, zinc oxide, and cadmium sulfide. Photoconductive materials for the photoconductor may also include organic photoconductive materials, such as poly-N-vinylcarbazole, 9,10-anthracenediolpolyester, hydrazone, stilbene, butadiene, benzidine, phthalocyanine compounds, and bisazo compounds. The photoconductive materials are dispersed in a resin binder or deposited by vacuum deposition or by sublimation. Various additives may also be included to improve the electrophotographic properties.

German Patent Specification No. 3 625 766 discloses phosphite compounds as a phosphorus containing additive for preventing photodeterioration in electrophotographic photoconductors. German Patent Specifications No. 2 117 509, No. 2 304 301, No. 2 834 871 and No. 2 944 154, U.S. Pat. No. 3,978,020 and the Japanese Unexamined Laid Open Patent Application No. S62-7725 describe phosphonite stabilizers for resin moldings. The phosphonite compounds have been used mainly to stabilize the resin moldings, which are subject to heat treatments at high temperatures. However, phosphonite compounds have not previously been used as additives to electrophotographic photoconductors.

OBJECTS AND SUMMARY OF THE INVENTION

In view of the foregoing, it is an object of the present invention to provide a highly stable photoconductor which contains a novel phosphonite additive in the photoconductor layer containing a charge transport agent.

It is another object of the present invention to provide an electrophotographic apparatus containing the photoconductor of the present invention.

It is another object of the present invention to provide a method of manufacturing such a photoconductor.

Briefly stated, an electrophotographic photoconductor includes a conductive substrate having a photoconductive film thereon. The photoconductive film includes a layer containing a charge transport agent and a phosphonite compound, which acts as an antioxidant. Preferably, the phosphonite compound is diarylarylphosphonite. The layer that contains the charge transport preferably contains from 0.005 to 10 weight % of diarylarylphosphonite. The diarylarylphosphonite is preferably a compound selected from the group consisting of bis(2,4-di-tert-butylphenyl) phenylphosphonite, bis(2,6-di-tert-butylphenyl) phenylphosphonite and bis(2,6-di-tert-butyl-4-methylphenyl)phenylphosphonite.

According to an embodiment of the present invention, a photoconductor for electrophotography comprises a conductive substrate, a photoconductive film on the conductive substrate, the photoconductive film including a layer having a charge transport agent, and the layer including a phosphonite compound.

According to another embodiment of the present invention, an electrophotographic apparatus comprises an electrophotographic photoconductor, the electrophotographic photoconductor containing a conductive substrate, a photoconductive film on the conductive substrate, the photoconductive film including a layer having a charge transport agent, and the layer including a phosphonite compound.

According to another embodiment of the present invention, a method of manufacturing an electrophotographic photoconductor comprises the steps of coating a photoconductive film onto a conductive substrate, the photoconductive film including a layer having a charge transport agent, and the layer including a phosphonite compound.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENT

An electrophotographic photoconductor according to the present invention includes a conductive substrate having a photoconductive film on the conductive substrate. The photoconductive film includes a layer containing a charge transport agent and a phosphonite compound, which acts as an antioxidant. Advantageously, the phosphonite compound is diarylarylphosphonite. The layer that contains the charge transport preferably contains from 0.005 to 10 weight % of diarylarylphosphonite. The diarylarylphosphonite is preferably a compound selected from the group consisting of bis(2,4-di-tert-butylphenyl)phenylphosphonite, bis(2,6-di-tert-butylphenyl)phenylphosphonite and bis(2,6-di-tert-butyl-4-methylphenyl)phenylphosphonite.

Electron density is higher around a phosphorus atom bonded to two oxygen atoms in a phosphonite compound than around a phosphorus atom bonded to three oxygen atoms in a phosphite compound. Therefore, due to this higher electron density, the anti-oxidation capability of a phosphonite compound is higher than that of a phosphite compound. The higher anti-oxidation activity improves the stability of the coating liquid for the layer which contains the charge transport, as well as that of the photoconductor containing the phosphonite compound.

Organic photoconductors may be classified into negative-charging laminate-type photoconductors, positive-charging laminate-type photoconductors, and positive-charging monolayered photoconductors. Hereinafter, the present invention will be described in terms of a negative-charging laminate-type photoconductor, in which the phosphonite compounds of the invention are used. The other materials and the processes for manufacturing the photoconductor of the invention are well-known in the art, and may be selected as appropriate.

Figure 1:
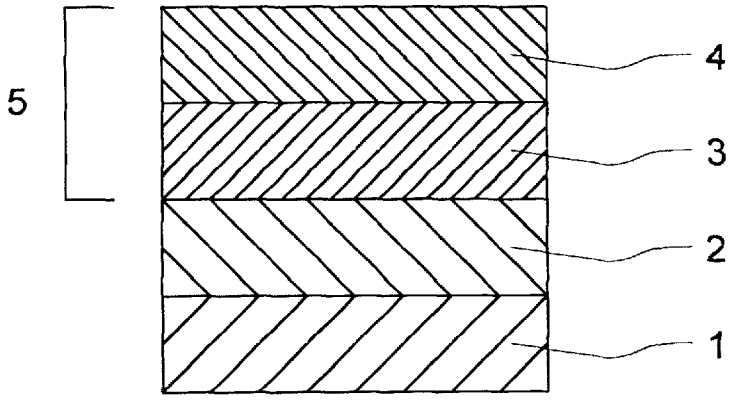
FIG. 1 is a cross-sectional diagram of a negative-charging laminate-type photoconductor.
Figure 2:
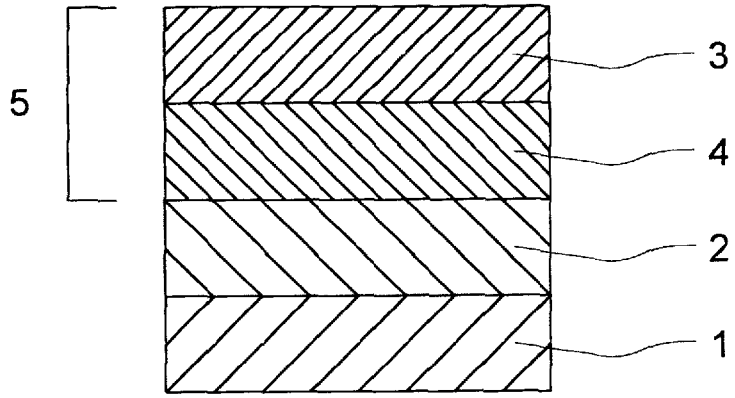
FIG. 2 is a cross-sectional diagram of a positive-charging laminate-type photoconductor.

Referring now to FIG. 1, a negative-charging laminate-type photoconductor includes a conductive substrate 1, an undercoating film 2 on conductive substrate 1, and a photoconductive film 5 on undercoating film 2. Undercoating film 2 is optional. Photoconductive film 5 includes a charge generation layer 3 for generating electric charges and a charge transport layer 4 for transporting electric charges generated by charge generation layer 3 in response to received light.

Figure 3:
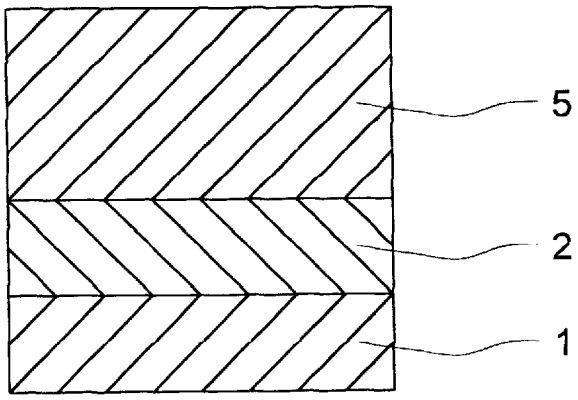
FIG. 3 is a cross-sectional diagram of a positive-charging monolayered-type photoconductor.

Referring now to FIG. 3, a positive-charging monolayered-type photoconductor includes a conductive substrate 1, an undercoating film 2 on conductive substrate 1, and a monolayered photoconductive film 5 on undercoating film 2. Undercoating film 2 is optional. Monolayered photoconductive film 5 performs the functions of charge generation and charge transport in a single layer.

Conductive substrate 1 works as an electrode of the photoconductor and a means for supporting the other constituent films and layers of the photoconductor. Conductive substrate 1 may be shaped as a cylindrical tube, a plate or a film. Metals such as aluminum, stainless steel and nickel may be used for conductive substrate 1. Glass and resin provided with electrical conductivity may also be used for conductive substrate 1.

Suitable resins for undercoating film 2 include alcohol-soluble polyamide, solvent-soluble aromatic polyamide, and thermosetting urethane resin. Preferable alcohol-soluble polyamides include copolymerized compounds of nylon 6, nylon 8, nylon 12, nylon 66, nylon 610 and nylon 612, N-alkyl modified nylon, and N-alkoxyalkyl modified nylon. Particularly preferred copolymerized compounds include the copolymerized nylon of nylon 6, nylon 66, nylon 610 and nylon 12 (Amilan CM 8000, from TORAY INDUSTRIES, INC.), the copolymerized nylon of nylon 6, nylon 66 and nylon 612 (Elbamide 9061, from Du Pont Japan Co., Ltd.) and copolymerized nylon comprised mainly of nylon 12 (DAIAMIDE T-170, from Daicel Hules Ltd.). Small-grained powders of inorganic compounds, such as $TiO_2$, alumina, calcium carbonate and silica may be included in undercoating film 2.

Charge generation layer 3 generates electric charges in response to the received light. Charge generation layer 3 may be formed by coating a resin binder containing the particles of an organic photoconductive material onto conductive substrate 1 or the appropriate layer. Alternatively, charge generation layer 3 may be formed by coating a resin binder containing a solvent into which an organic photoconductive material is dispersed onto conductive substrate 1 or the appropriate layer. It is important for charge generation layer 3 to exhibit a high charge generation efficiency. It is also important for charge generation layer 3 to facilitate injecting the generated charges into charge transport layer 4. It is further desirable that the charge-injection efficiency of charge generation layer 3 be independent of the electric field, and that the charge-injection efficiency be sufficiently high even in a low electric field. Suitable charge generation agents include pigments and dyes, such as various phthalocyanine compounds, azo compounds, quinone compounds, indigo compounds, cyanine compounds, squalane compounds, and azulenium compounds. Since charge generation layer 3 is only required to exhibit charge generation function, the thickness of the layer is the thinnest possible while still providing the necessary photosensitivity. The charge generation layer is usually 5 $\mu$m or less, and preferably 1 $\mu$m or less in thickness.

Charge generation layer 3 mainly contains a charge generation agent. Charge generation layer 3 may also contain a charge transport agent. Suitable binder resins for charge generation layer 3 include polymers, copolymers, halides and cyanoethyl compounds of polycarbonate, polyester, polyamide, polyurethane, epoxy, poly(vinyl butyral), phenoxy, silicone, metacrylate, vinyl chloride, ketal, vinyl acetate and their appropriate combinations. Between 10 to 500 weight parts, and preferably between 50 to 100 weight parts of a charge generation agent are generally used with respect to 100 weight parts of the binder resin.

Charge transport layer 4 is a coating layer containing a resin binder into which at least one charge transport agent selected from various hydrazone compounds, styryl compounds, amine compounds and their derivatives is dissolved. Charge transport layer 4 works as an insulator which retains electric charges of the photoconductor in the dark and as a conductor which transports the electric charges injected from charge generation layer 3 in response to received light. Suitable binder resins for charge transport layer 4 may be selected from polymers and copolymers of polycarbonate, polyester, polystyrene and polymethacrylate, by considering the requirements for mechanical stability, chemical stability, electrical stability, adhesiveness and solubility of the charge transport agent. Between 20 to 500 weight parts, and preferably between 30 to 300 weight parts of a charge transport agent are used with respect to 100 weight parts of a binder resin. The thickness of the charge transport layer is preferably between 3 to 50 $\mu$m to maintain a practical and effective surface potential, and more preferably, between 15 to 40 $\mu$m.

Charge transport layer 4 and the coating liquid for charge transport layer 4 contain at least one binder resin and at least one of the charge transport agents described above. Charge transport layer 4 also contains one of the phosphonite compounds according to the present invention, as described below.

Figure 4:
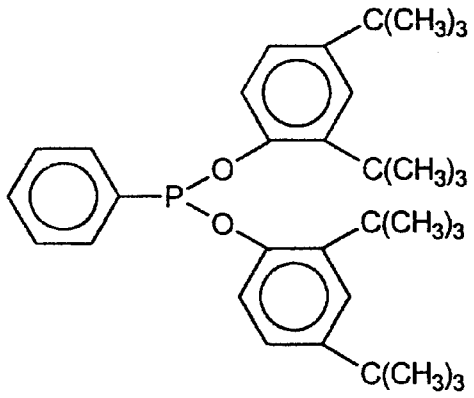
FIG. 4 shows the chemical formula of bis(2,4-di-tert-butylphenyl) phenylphosphonite.
Figure 5:
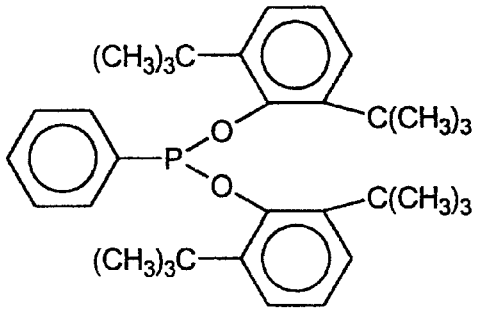
FIG. 5 shows the chemical formula of bis(2,6-di-tert-butylphenyl) phenylphosphonite.
Figure 6:
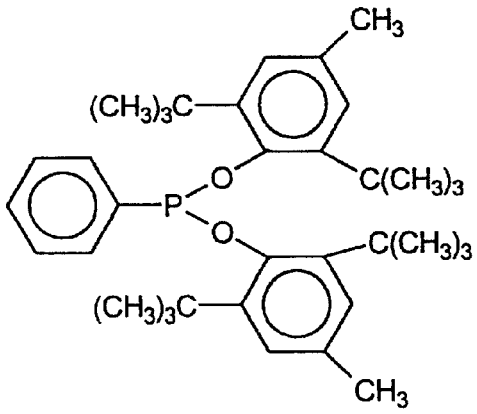
FIG. 6 shows the chemical formula of bis(2,6-di-tert-butyl-4-methylphenyl)phenylphosphonite.

Preferable phosphonite compounds according to the present invention include diarylarylphosphonite compounds. Especially preferable are bis(2,4-di-tert-butylphenyl) phenylphosphonite, described by the chemical formula (1) in FIG. 4, bis(2,6-di-tert-butylphenyl) phenylphosphonite described by the chemical formula (2) in FIG. 5, and bis(2,6-di-tert-butyl-4-methylphenyl) phenylphosphonite described by the chemical formula (3) in FIG. 6. The phosphonite compounds may be synthesized by the methods described by G. M. Kosolapoff, et al., in "Organic Phosphorous Compounds", 2nd ed., Wiley-Interscience, New York, 1972, vol. 4 and by S. D. Pastor et al., in Phosphorus Sulfur, 22(2):169 (1985). The content of the phosphonite compound in a layer containing a charge transport agent is preferably between 0.005 to 10 weight %, and, more preferably, from 0.01 to 5 weight %.

The phosphonite compounds according to the present invention may be incorporated into a photoconductive film of a monolayered photoconductor, as well as into a laminated photoconductor. The phosphonite-containing coating liquid may be coated by any conventional coating method, such as a dip-coating method or a spray-coating method.

Embodiment 1

Coating liquid for an undercoating film was prepared by mixing 70 weight parts of polyamide resin (Amilan CM 8000, from TORAY INDUSTRIES, INC.) and 930 weight parts of methanol (from Wako Pure Chemical Industries Ltd.). The coating liquid was coated on an aluminum substrate by dip-coating, producing an undercoating film of 0.5 μm in dry film thickness.

Coating liquid for a charge generation layer was prepared by mixing 10 weight parts of titanyloxyphthalocyanine (synthesized in Fuji Electric Co., Ltd.), 686 weight parts of dichloromethane (from Wako Pure Chemical Industries Ltd.), 294 weight parts of 1,2 dichloroethane (from Wako Pure Chemical Industries Ltd.), and 10 weight parts of vinyl chloride resin (MR-110, from Nippon Zeon Co., Ltd.). These components were dispersed by ultrasonic dispersion. The coating liquid for the charge generation layer was coated onto the undercoating film by dip-coating, forming a charge generation layer of 0.2 μm in dry thickness.

A coating liquid for the charge transport layer was prepared by mixing 100 weight parts of 4-(diphenylamino) benzaldehyde phenyl(2-thienyl methyl) hydrazone (synthesized in Fuji Electric Co., Ltd.), 100 weight parts of polycarbonate resin (Panlite K-1300, from TEIJIN LTD.), 800 weight parts of dichloromethane, 1 weight part of silane coupling agent (KP-340, from Shin-Etsu Chemical Co., Ltd.) and 4 weight parts of bis(2,4-di-tert-butylphenyl) phenylphosphonite (synthesized in Fuji Electric Co., Ltd.). The coating liquid for the charge transport layer was coated onto the charge generation layer by dip-coating, forming a charge transport layer of 20 μm in dry thickness. The quantity of the phosphonite compound corresponded to 2% by weight of the charge transport layer.

Embodiment 2

The photoconductor of Embodiment 2 was fabricated in the same manner as the photoconductor of Embodiment 1, except that 0.01 weight parts of bis(2,4-di-tert-butylphenyl) phenylphosphonite was used in the charge transport layer of the photoconductor of Embodiment 2.

Embodiment 3

The photoconductor of Embodiment 3 was fabricated in the same manner as the photoconductor of Embodiment 1, except that 20 weight parts of bis(2,4-di-tert-butylphenyl) phenylphosphonite was used in the charge transport layer of the photoconductor of Embodiment 3.

Embodiment 4

The photoconductor of Embodiment 4 was fabricated in the same manner as the photoconductor of Embodiment 1, except that the 4 weight parts of bis(2,4-di-tert-butylphenyl) phenylphosphonite in the charge transport layer of the photoconductor of Embodiment 1 was replaced by 4 weight parts of bis(2,6-di-tert-butyl-4-methylphenyl) phenylphosphonite in the charge transport layer of the photoconductor of Embodiment 4.

Embodiment 5

The photoconductor of Embodiment 5 was fabricated in the same manner as the photoconductor of Embodiment 4, except that 0.01 weight parts of bis(2,6-di-tert-butyl-4-methylphenyl)phenylphosphonite was used in the charge transport layer of the photoconductor of Embodiment 5.

Embodiment 6

The photoconductor of Embodiment 6 was fabricated in the same manner as the photoconductor of Embodiment 4, except that 20 weight parts of bis(2,4-di-tert-butyl-4-methylphenyl)phenylphosphonite was used in the charge transport layer of the photoconductor of Embodiment 6.

Embodiment 7

The photoconductor of Embodiment 7 was fabricated in a similar manner as the photoconductor of Embodiment 1, except that the coating liquid for the charge transport layer of Embodiment 1 was stored for a month before the photoconductor of Embodiment 7 was prepared.

Embodiment 8

The photoconductor of Embodiment 8 was fabricated in a similar manner as the photoconductor of Embodiment 2, except that the coating liquid for the charge transport layer of Embodiment 2 was stored for a month before the photoconductor of Embodiment 8 was prepared.

Embodiment 9

The photoconductor of Embodiment 9 was fabricated in a similar manner as the photoconductor of Embodiment 3, except that the coating liquid for the charge transport layer of Embodiment 3 was stored for a month before the photoconductor of Embodiment 9 was prepared.

Embodiment 10

The photoconductor of Embodiment 10 was fabricated in a similar manner as the photoconductor of Embodiment 4, except that the coating liquid for the charge transport layer of Embodiment 4 was stored for a month before the photoconductor of Embodiment 10 was prepared.

Embodiment 11

The photoconductor of Embodiment 11 was fabricated in a similar manner as the photoconductor of Embodiment 5, except that the coating liquid for the charge transport layer of Embodiment 5 was stored for a month before the photoconductor of Embodiment 11 was prepared.

Embodiment 12

The photoconductor of Embodiment 12 was fabricated in a similar manner as the photoconductor of Embodiment 6, except that the coating liquid for the charge transport layer of Embodiment 6 was stored for a month before the photoconductor of Embodiment 12 was prepared.

Comparative Example 1

The photoconductor of Comparative Example 1 was fabricated in the same manner as the photoconductor of Embodiment 1, except that bis(2,4-di-tert-butylphenyl) phenylphosphonite was not added to the coating liquid for the charge transport layer.

Comparative Example 2

The photoconductor of Comparative Example 2 was fabricated in the same manner as the photoconductor of Embodiment 1, except that 40 weight parts of bis(2,4-di-tert-butylphenyl)phenylphosphonite was used in the photoconductor of Comparative Example 2.

Comparative Example 3

The photoconductor of Comparative Example 3 was fabricated in the same manner as the photoconductor of Embodiment 4, except that 40 weight parts of bis(2,4-di-tert-butyl-4-methylphenyl)phenylphosphonite was used in the photoconductor of Comparative Example 3.

Comparative Example 4

The photoconductor of Comparative Example 4 was fabricated in a similar manner as the photoconductor of Comparative Example 1, except that the coating liquid for the charge transport layer of Comparative Example 1 was stored for a month before the photoconductor of Comparative Example 4 was prepared.

The electrical properties of the photoconductors of Embodiments 1 through 12 and the Comparative Examples 1 through 4 were measured in an electrostatic recording paper testing apparatus (EPA-8200, from Kawaguchi Electric Works Co., Ltd.). The initial residual potential was measured after charging the photoconductor surface to be negative by corona discharge of −5 kV for 10 sec in the dark, followed by irradiation of the charged photoconductor surface by 5 $\mu J/cm^2$ of a 780 nm laser beam. The residual potential after light exposure was measured by exposing the photoconductor surface to a white luminescent light of 1000 lx after the initial residual potential measurement and thereafter storing the photoconductor in the dark for 24 hr. Table 1 shows the residual potentials of the photoconductors and their stability.

TABLE 1

| Photo-conductors | Initial residual potential (V) | Residual potential after light exposure (V) | Evalu-ation |
|---|---|---|---|
| Embodiment 1 | −15 | −15 | ○ |
| Embodiment 2 | −14 | −15 | ○ |
| Embodiment 3 | −16 | −17 | ○ |
| Embodiment 4 | −14 | −14 | ○ |
| Embodiment 5 | −13 | −13 | ○ |
| Embodiment 6 | −15 | −15 | ○ |
| Embodiment 7 | −15 | −15 | ○ |
| Embodiment 8 | −15 | −16 | ○ |
| Embodiment 9 | −16 | −17 | ○ |
| Embodiment 10 | −14 | −14 | ○ |
| Embodiment 11 | −14 | −15 | ○ |
| Embodiment 12 | −15 | −15 | ○ |
| Comp. Ex. 1 | −16 | −39 | X |
| Comp. Ex. 2 | −35 | −41 | X |
| Comp. Ex. 3 | −34 | −40 | X |
| Comp, Ex. 4 | −45 | −66 | X |

The symbol "○" denotes an acceptable performance
The symbol "X" denotes an unacceptable performance As Table 1 indicates, the residual potentials of the photoconductors of Embodiments 1–12 remain at low values, both as initial residual values and after light exposure. In contrast, the photoconductors of the Comparative Examples 1 through 4 all had higher values after light exposure. In addition, the photoconductors of Comparative Examples 2–4 all had high initial residual values. The results indicate that the photoconductors of the present invention exhibit superior stability.

Although the photoconductors according to the Embodiments and the Comparative Examples contain a single kind of phosphonite compound, it is to be understood that the same favorable effects are obtained in photoconductors which contain two or more kinds of phosphonite compounds in a layer containing a charge transport agent.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A photoconductor for electrophotography, comprising:

a conductive substrate;

a photoconductive film on said conductive substrate;

said photoconductive film including a layer having a charge transport agent; and said layer including a phosphonite compound.

2. A photoconductor according to claim 1, wherein said phosphonite compound is diarylarylphosphonite.

3. A photoconductor according to claim 2, wherein said layer contains from 0.005 to 10% by weight of said diarylarylphosphonite.

4. A photoconductor according to claim 2, wherein said diarylarylphosphonite is a member selected from the group consisting of bis(2,4-di-tert-butylphenyl) phenylphosphonite, bis(2,6-di-tert-butylphenyl) phenylphosphonite, and bis(2,6-di-tert-butyl-4-methylphenyl)phenylphosphonite.

5. A photoconductor according to claim 2, wherein:

said diarylarylphosphonite is a member selected from the group consisting of bis(2,4-di-tert-butylphenyl) phenylphosphonite, bis(2,6-di-tert-butylphenyl) phenylphosphonite, and bis(2,6-di-tert-butyl-4-methylphenyl)phenylphosphonite; and said layer contains from 0.005 to 10% by weight of said diarylarylphosphonite.

6. An electrophotographic apparatus, comprising:

an electrophotographic photoconductor;

said electrophotographic photoconductor containing a conductive substrate;

a photoconductive film on said conductive substrate;

said photoconductive film including a layer having a charge transport agent; and said layer including a phosphonite compound.

7. An electrophotographic apparatus according to claim 6, wherein said phosphonite compound is diarylarylphosphonite.

8. An electrophotographic apparatus according to claim 7, wherein said layer contains from 0.005 to 10% by weight of said diarylarylphosphonite.

9. An electrophotographic apparatus according to claim 7, wherein said diarylarylphosphonite is a member selected from the group consisting of bis(2,4-di-tert-butylphenyl) phenylphosphonite, bis(2,6-di-tert-butylphenyl) phenylphosphonite, and bis(2,6- di-tert-butyl-4-methylphenyl)phenylphosphonite.

10. An electrophotographic apparatus according to claim 7, wherein:

said diarylarylphosphonite is a member selected from the group consisting of bis(2,4-di-tert-butylphenyl) phenylphosphonite, bis(2,6-di-tert-butylphenyl) phenylphosphonite, and bis(2,6-di-tert-butyl-4-methylphenyl)phenylphosphonite; and said layer contains from 0.005 to 10% by weight of said diarylarylphosphonite.

11. A method of manufacturing an electrophotographic photoconductor, comprising the steps of:

coating a photoconductive film onto a conductive substrate;

said photoconductive film including a layer having a charge transport agent; and said layer including a phosphonite compound.

12. A method of manufacturing an electrophotographic photoconductor according to claim 11, wherein said phosphonite compound is diarylarylphosphonite.

13. A method of manufacturing an electrophotographic photoconductor according to claim 12, wherein said layer contains from 0.005 to 10% by weight of said diarylarylphosphonite.

14. A method of manufacturing an electrophotographic photoconductor according to claim 12, wherein said diarylarylphosphonite is a member selected from the group consisting of bis(2,4-di-tert-butylphenyl) phenylphosphonite, bis(2,6-di-tert-butylphenyl) phenylphosphonite, and bis(2,6-di-tert-butyl-4-methylphenyl)phenylphosphonite.

15. A method of manufacturing an electrophotographic photoconductor according to claim 12, wherein:

said diarylarylphosphonite is a member selected from the group consisting of bis(2,4-di-tert-butylphenyl) phenylphosphonite, bis(2,6-di-tert-butylphenyl) phenylphosphonite, and bis(2,6-di-tert-butyl-4-methylphenyl)phenylphosphonite; and said layer contains from 0.005 to 10% by weight of said diarylarylphosphonite.

* * * * *